US009672732B1

(12) United States Patent
Aladas

(10) Patent No.: US 9,672,732 B1
(45) Date of Patent: Jun. 6, 2017

(54) INTEGRATED ACCESSIBLE PEDESTRIAN SYSTEM

(71) Applicant: Motaz Aladas, Ottawa (CA)

(72) Inventor: Motaz Aladas, Ottawa (CA)

( * ) Notice: Subject to any disclaimer, the term of this patent is extended or adjusted under 35 U.S.C. 154(b) by 0 days.

(21) Appl. No.: 15/468,252

(22) Filed: Mar. 24, 2017

Related U.S. Application Data

(60) Provisional application No. 62/349,308, filed on Jun. 13, 2016.

(51) Int. Cl.
*G08G 1/095* (2006.01)
*G08G 1/005* (2006.01)
*G08C 17/02* (2006.01)

(52) U.S. Cl.
CPC ..... *G08G 1/005* (2013.01); *G08C 17/02* (2013.01)

(58) Field of Classification Search
CPC ..... G08B 1/005; G08B 1/095; G08C 17/02
USPC ..... 340/905, 906, 925, 944
See application file for complete search history.

(56) References Cited

U.S. PATENT DOCUMENTS 8,786,466 B1 7/2014 Aladas
2002/0063632 A1* 5/2002 Bowman ..... G06F 1/163 340/4.1
2016/0267787 A1* 9/2016 Whitney ..... G08G 1/005

* cited by examiner

*Primary Examiner* — Tai T Nguyen

(57) ABSTRACT

An integrated pedestrian access system comprising of wireless push buttons adapted to transmit and receive wireless signals and receivers connected to pedestrian crosswalk signal systems, wherein said one or more receivers are configured to communicate with the wireless push buttons through wireless signals, communicate among the receivers, determine whether source device from which a request for registering a pedestrian signal is received through the said communication is the wireless push button or the receivers, determine status of pedestrian signal based on signals received from the pedestrian signal system, register request for pedestrian crosswalk signal if walk signal of the pedestrian signal is not on in the desired direction as per the status of pedestrian signal and provide acknowledgement corresponding to the status of pedestrian signal through the said source device.

30 Claims, 5 Drawing Sheets

INTEGRATED ACCESSIBLE PEDESTRIAN SYSTEM

CROSS-REFERENCE TO RELATED APPLICATIONS

This application claims the benefit of U.S. Provisional Application No. 62/349,308, filed Jun. 13, 2016, the contents of which are incorporated herein by reference.

FIELD OF THE INVENTION

The present invention relates to traffic control systems. More particularly, the present invention relates to integrated wired and wireless accessible pedestrian system.

BACKGROUND OF THE INVENTION

Signs and signals are installed at pedestrian crosswalks for facilitating safe and smooth crossing of street by pedestrians. Pedestrian crosswalk signals can be of automatic type where the WALK/DON'T WALK signals come at a predefined interval or can be of manual type where the crosswalk signal system is triggered manually by pedestrians when they press a pedestrian push button installed near the crosswalk. There are various types of pedestrian push button systems known in the prior art which have been built to make the pedestrian crosswalk signal systems accessible for the visually and/or hearing impaired pedestrians.

However, there was no pedestrian push button system available which could be activated from a distance. As a solution to this problem, a wireless push button device for pedestrian crosswalk signal system was invented that is capable of giving alert to the users of the remote to confirm WALK/DON'T WALK in the form of audio, tactile and visual signals. This wireless push button device for pedestrian crosswalk signal system is disclosed in detail in U.S. Pat. No. 8,786,466 issued Jul. 22, 2014 to the inventor and applicant of this present application.

To provide the visually and/or hearing impaired pedestrians same kind of facilities as those provided by the above mentioned wireless push button, even without possessing the remote push button, it is now desirable that the features of the above mentioned wireless push button device are also incorporated into a traffic signal pole mounted pedestrian push button system. Also, there is a need for a system that can guide continuously visually impaired pedestrians to walk in the right direction while crossing a street.

OBJECTS OF THE INVENTION

An object of the present invention to provide a system and method for an accessible pedestrian system integrated to support both wireless pedestrian push button and pole mounted pedestrian push button.

Yet another object of the present invention is to provide a system and method for an accessible pedestrian system to enable registration of a request for pedestrian crosswalk signal through multiple means.

Still another object of the present invention is to provide a system and method for an accessible pedestrian system which provides pedestrian signal information in multiple formats.

These as well as other objects of the present invention are apparent upon inspection of this specification, including the drawings and appendices attached hereto.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The present invention is directed to an accessible pedestrian system and method which facilitates users, particularly visually impaired and/or hearing impaired pedestrians, to register a request for pedestrian signal, both from a distance as well as locally, and to know about the status of the pedestrian signal in the form of visual, audible and tactile messages.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the scope of the present invention. Thus, the present invention is not intended to be limited to the embodiments shown, but is to be accorded the widest scope consistent with the principles and features disclosed herein.

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

Figure 1:
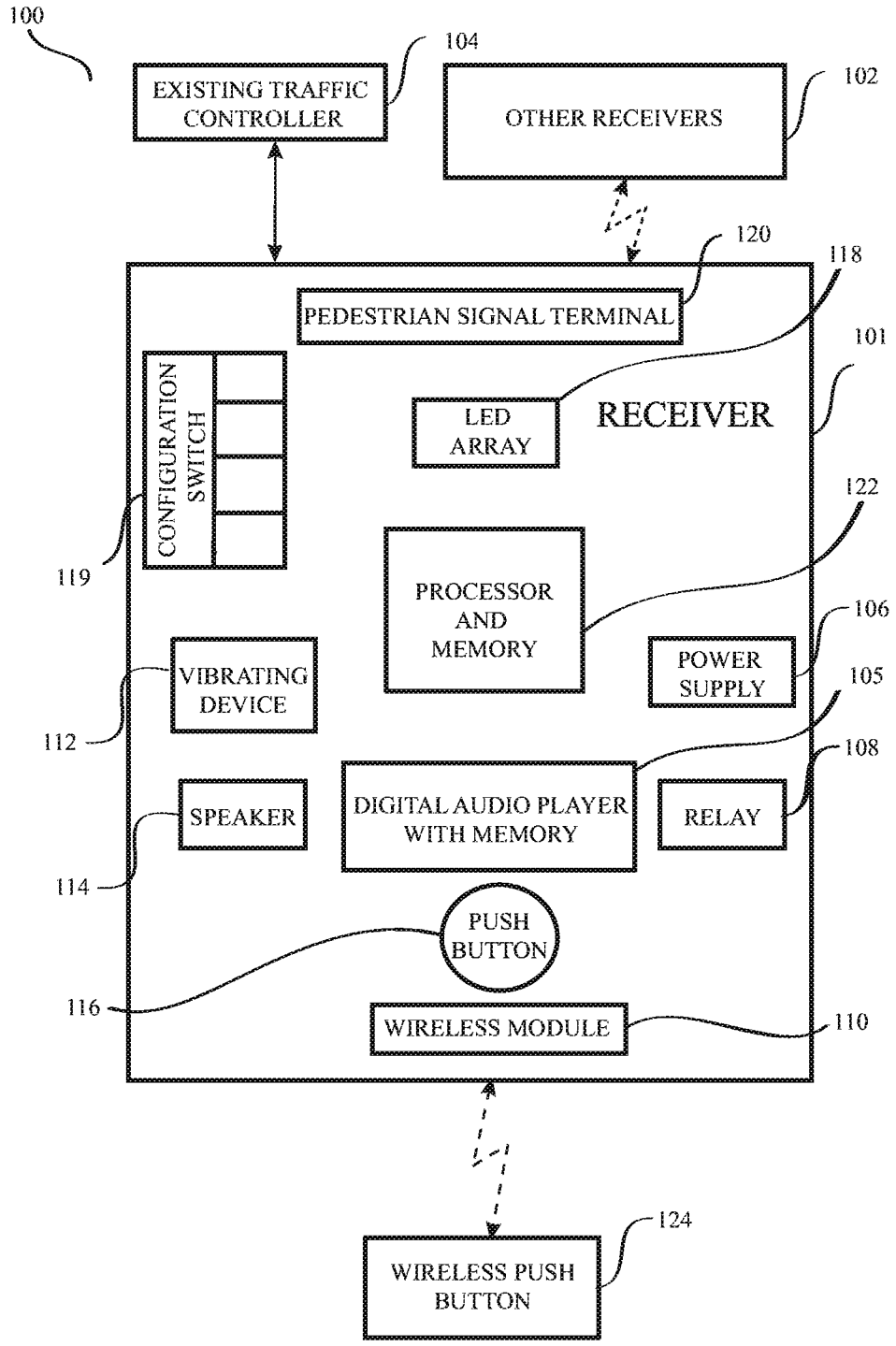
FIG. 1 is a block diagram of the integrated accessible pedestrian system of the present invention along with other interacting components.
Figure 2:
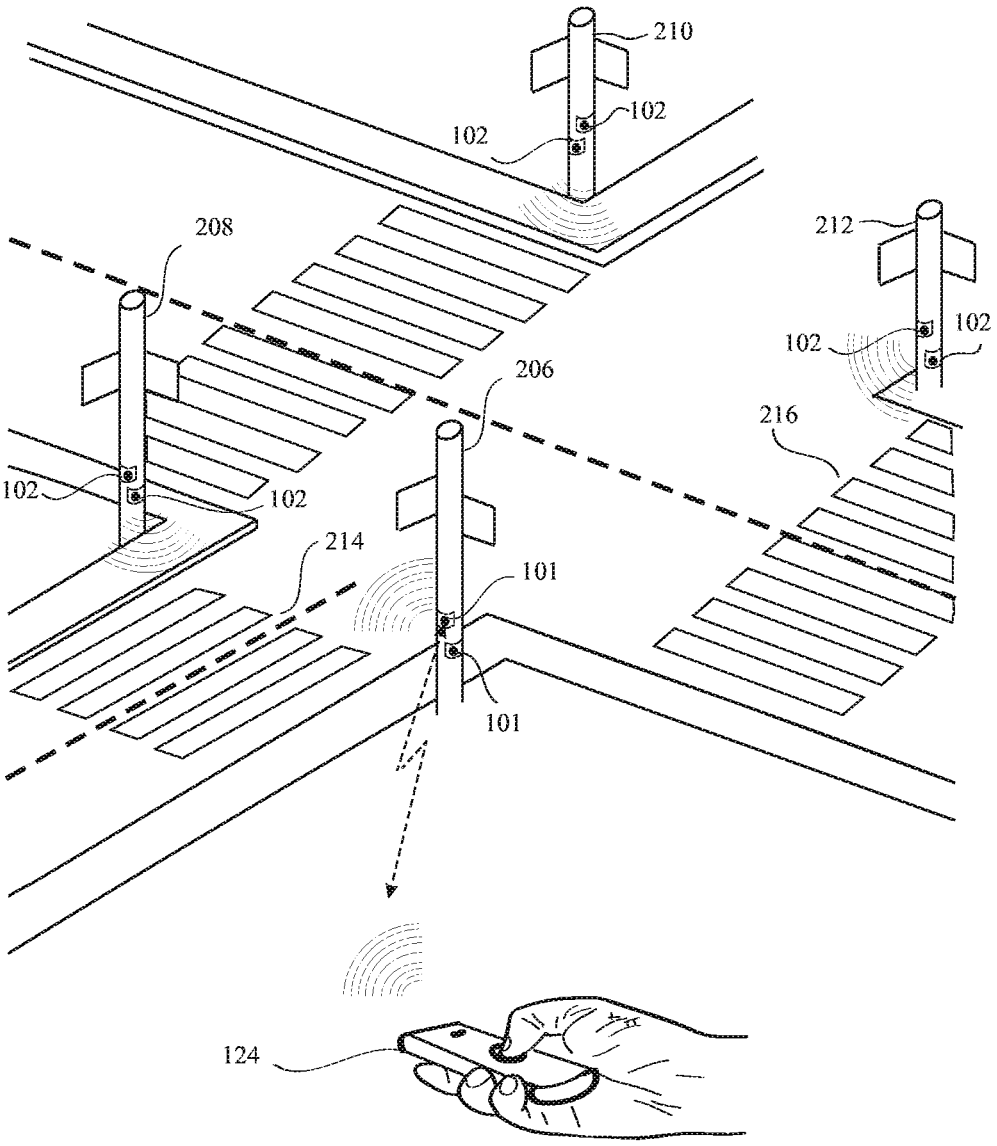
FIG. 2 illustrates a general environment for implementing the principles of the present invention.

FIG. 1 and FIG. 2 illustrate an integrated accessible pedestrian system 100. The integrated accessible pedestrian access system 100 of the present invention includes one or more pedestrian push button assemblies 101 (hereinafter referred to as receivers 101) which can be mounted on traffic poles and/or can also be installed at the controller's location, one or more wireless push button assemblies 124 (hereinafter referred to as wireless push button 124 or remote 124) known in the art wherein the one or more receivers 101 are communicatively connected to one or more existing traffic controllers 104. The traffic controllers are the systems which use traffic lights for controlling traffic movement at intersections. As shown in FIG. 1, the receiver 101 includes a wireless module 110 for receiving and transmitting signals wirelessly, a push button 116 for registering a request for pedestrian signal, a speaker 114 to play audio from digital audio player 105; the digital audio player 105 also includes provision for memory to store digital audio and video files, one or more relays 108 for switching purpose, one or more processors and memory 122 (also referred to as microcontroller 122), one or more vibrating device 112 which can make the body and front plate of the receiver 101 vibrate, one or more arrays of Light Emitting Diode (LED) or any source of light 118 to indicate pedestrian signal status, and one or more configuration switches 119 required for setting the direction details in receiver 101 as per requirement. The receiver 101 interacts with the existing traffic controller 104 through connections made from the traffic controller 104 to register a request for pedestrian signal. The receiver 101 communicates with the existing one or more traffic/pedestrian signal heads (not shown in the FIG. 1) and/or with the existing traffic controller 104 through the pedestrian signal terminal 120 to check for status of the pedestrian signal as well to check existence of any conflict in the pedestrian signals. The wireless push button 124 used here is the one envisioned through U.S. Pat. No. 8,786,466 or any mobile computing device configured to perform the functions of the wireless push button 124 with the help of a native software application or app or mobile app. With the mobile app installed a mobile computing device can act as the wireless push button 124. The mobile app can help a mobile device communicate with the receiver 101 the same way a wireless push button 124 does. Examples of mobile device include, but not limited to, mobile phones, smart phones, tablets etc.

Hereinafter, the terms "wireless push button" and "remote" are used alternatively and interchangeably. In the context of the present invention the wireless push button 124 is a device that enables registration of a pedestrian signal call request from a distance wirelessly. It also provides pedestrian signal status information in visual, audible and tactile forms. The wireless push button 124 is capable of scanning, receiving and broadcasting wireless messages. The push button 116 can be a capacitor switch or a regular switch.

The wireless module 110 of the receiver can include a Bluetooth module. Although, the system and method of the present invention is described hereinafter with reference to Bluetooth protocol or Bluetooth Low Energy protocol, it is to be understood that the concept of the present invention can be accomplished through other wireless protocols also such as through Wifi, Zigbee, UWB etc. In a preferred embodiment, the wireless module 110 broadcasts Bluetooth Low Energy advertising packets. Hereinafter, the terms "advertising packet", "advertising message", "wireless message", "beacon packet" and "beacon message" are used interchangeably and alternatively.

Reference to FIG. 1 and FIG. 2, in the exemplary environment, one or more receivers 101 are mounted on existing traffic signal poles 206, 208, 210 and on 212. For explanation purpose, receiver 101 mounted on traffic poles other than 206 i.e. those installed at traffic poles 208, 210 and 212, are referred to as receiver 102 although their functionality remains same as that of the one installed at traffic pole 206. Also, alternatively, receiver 101 is sometimes hereinafter referred to as first receiver 101 and the rest of the receivers 102 are collectively referred to as other receivers 102. For each receiver, angle values, hereinafter referred to as receiver angle values, with respect to the crosswalk directions where the receivers are installed, are stored in the receivers with the help of configuration switches 119 at the time of installation or by using a special device to remotely configure the configuration of the receivers.

The working principle of the present invention is described hereinafter taking an example of a visually impaired and/or hearing impaired person approaching a traffic intersection with intent to cross the street through crosswalk 214 from the traffic pole side 206 as shown in FIG. 2. The said pedestrian can use a wireless push button 124 to register a request for pedestrian signal from a distance. Alternatively, the pedestrian can use the push button on the receiver 101 installed in the traffic pole 206 to register a request for pedestrian signal.

Figure 3:
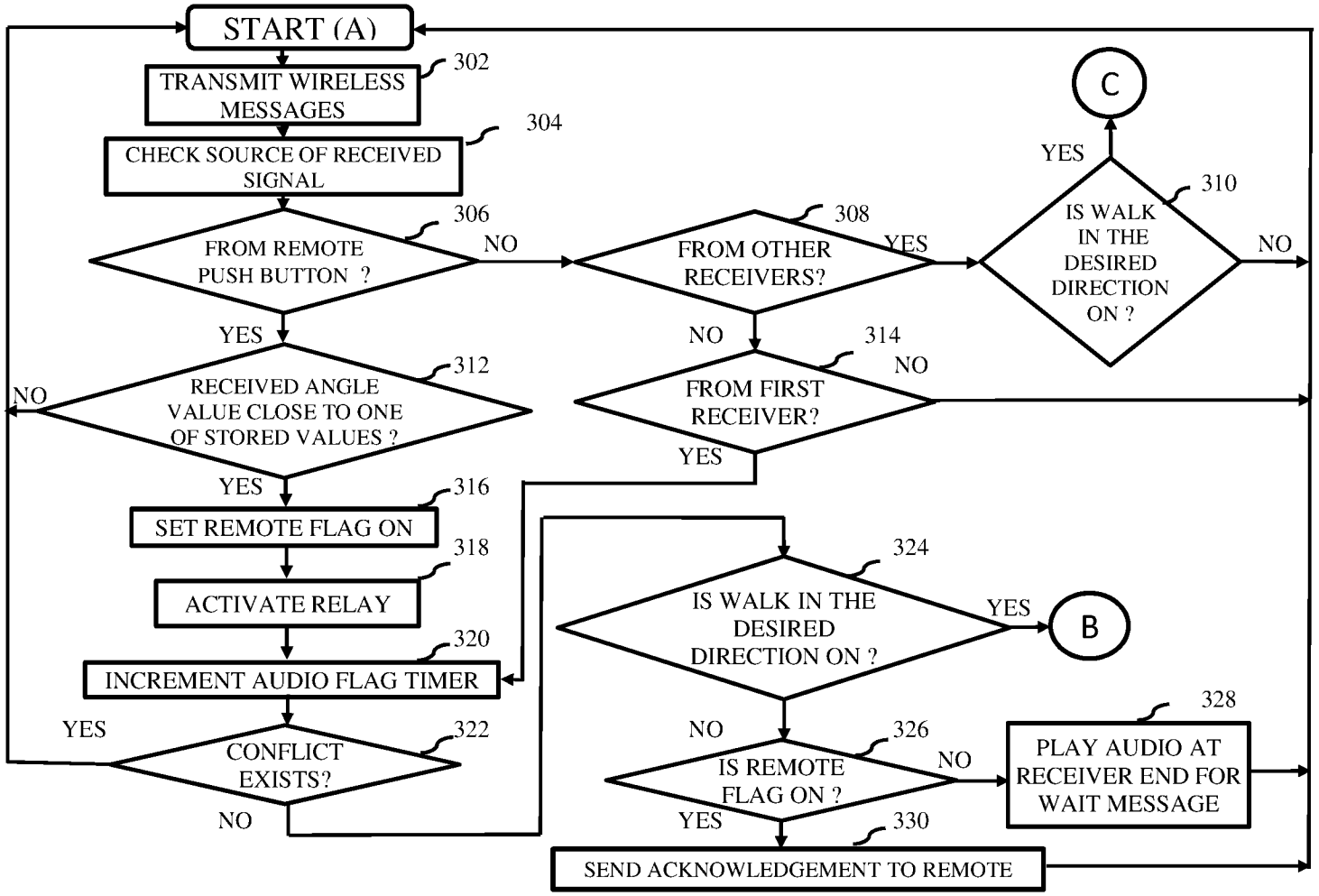
FIG. 3 and FIG. 4 show a flow diagram illustrating the functioning of the integrated accessible pedestrian system in accordance with an embodiment of the present invention.

The wireless module 110 of the receivers 101 is configured to generate a plurality of different types of beacon messages or wireless messages continuously or periodically, as desired. The generated wireless messages are transmitted, as in step 302 of FIG. 3, by the wireless module 110 for reception by one or more wireless push buttons 124 located in the transmission area.

In a preferred embodiment, as defined by the wireless message format, the different types of wireless messages transmitted/broadcasted by the wireless module 110 comprise 3 major types of messages—a first type of wireless message that includes the receiver angle values stored in the receiver memory 122 with respect to the crosswalk directions for a particular receiver, a second type of wireless message that includes information specific to the location of the receiver and which can optionally enable the wireless push button to retrieve related information from a remote server, and a third type of wireless message that includes the status of the traffic signal. The different types of wireless messages can be transmitted/broadcasted alternately and intermittently.

In one embodiment, the receiver angle value and geographic coordinate system information i.e. location information for a receiver are stored in a back end server. Based on the location information of the wireless push button, as determined with the help of the GPS feature of the wireless push button, the wireless push button can obtain the receiver angle value for the receiver from the back end server i.e. from the remote server when the wireless push button comes in close proximity of the receiver. Thus, in this embodiment, the wireless push button can become aware of the receiver angle value even when the receiver angle value is not broadcasted by the receiver.

In the present example, when the pedestrian holds and activates (i.e. presses the push button and/or activates the app) the wireless push button 124 in the direction of the crosswalk 214, the compass present in the wireless push button 124 records the angle of orientation of the wireless push button 124. This angle value, preferably corrected with the reading of the gyroscope included in the wireless push button, is hereinafter referred to as wireless push button angle value. The wireless push buttons 124, configured to receive the plurality of wireless messages, perform at least one action based on at least a part of the data included in the wireless messages. In some embodiments, this action can be performed by the wireless push button 124 without receiving any input from a user of the wireless push button 124. Accordingly, when the wireless push button 124 receives the first type of wireless message, among other types, it compares the receiver angle value included in the first type of wireless message with the wireless push button angle value recorded by the wireless push button 124. If the wireless push button 124 finds the wireless push button angle value to be falling within a predetermined acceptable range of values corresponding to the receiver angle value then the wireless push button 124 is supposed to be held directed to the right direction and the wireless push button 124 sends a message including the wireless push button angle value along with a pedestrian signal request to the receiver for registration of pedestrian signal in the direction of the wireless push button angle value. The predetermined acceptable range of values can be a range of values already defined and stored in the wireless push button for any receiver angle value or it can be a range of values indicated by the wireless message transmitted by the receiver for the transmitted receiver angle value. While matching of wireless push button angle value with receiver angle value range is a first condition for establishing an association, there can be some more conditions which may be required to be fulfilled for establishing an association between a wireless push button and a receiver. In the present example, the wireless push button 124 sends the request for registration of pedestrian signal in the direction of crosswalk 214 from the side of the traffic pole 206. In some embodiments, the receivers do not broadcast receiver angle values and the wireless push button 124 transmits the wireless push button angle value even without receiving and matching the receiver angle value to all the receivers.

In some embodiments, every wireless push button 124, while transmitting the wireless push button angle value, would also transmit a unique number or code or identity which can distinguish one wireless push button 124 from every other such wireless push buttons which may be active in the same area at the same time. Every receiver, be it receiver 101 or 102, receiving the signals from the one or more wireless push buttons 124, can respond to the wireless push buttons 124 with a code unique to each of the receivers. A connection or association or pairing is thus established between a particular pair of wireless push button and receiver when the wireless push button angle value received by the receiver is found to be falling within a predetermined acceptable range of values corresponding to a receiver angle value. In some embodiments, to make sure that it interacts only with the nearest receiver, the wireless push button takes into consideration one or more parameters apart from the receiver angle value. For example, as a second condition, a maximum distance from/around the receiver can be defined lying within which only a wireless push button should enter into an association with or make further communication to the receiver if angle values are found okay. This information on the maximum distance for a receiver can be retrieved by a wireless push button with the help of the app from a back end server based on the identity of the receiver found from the wireless messages received by the wireless push button from the receiver. Alternatively, the maximum distance information can also be included in the wireless messages broadcasted by the receivers. A wireless push button does not associate itself with the receivers for which the wireless push button lies outside their maximum distance limits. For example, for receiver 101 and other receivers 102, a distance/radius of 10 meters can be set as the maximum distance/radius from the individual receivers lying within which a wireless push button should establish association with a particular receiver provided the receiver angle value matches the wireless push button angle value. When the wireless push button comes within 10 meters from the receiver 101, the wireless push button may receive wireless messages from the other receivers 102 also and the receiver angle values of those one or more other receivers 102 may also be same with that of receiver 101. However, in this case, the wireless push button selects only receiver 101 for further communication because the wireless push button lies at a distance more than 10 meters from the rest of the receivers 102. In some embodiments, among all the receivers responding, a wireless push button 124 would establish an association with the only receiver from which the wireless push button receives the acknowledgement first. Once an association is established between a wireless push button and a receiver, only that receiver would do the ensuing communication with the wireless push button with which the receiver has an association. Since every wireless push button carries a unique identity, based on that identity, a receiver can establish independent association with multiple wireless push buttons simultaneously. In some embodiments, the receiver talks to one remote at a time, do the transaction and drop connection, and go to wait for a new connection state. This process is very short and the receiver becomes available in few seconds. In some embodiments, using the same aforementioned method, the association or pairing between a wireless push button and a receiver can be established through any other wireless data exchange standards such as Bluetooth, Zigbee, IrDA etc. In a preferred embodiment, all the communications occurring among the devices i.e. among the one or more receivers, among one or more receivers and one or more wireless push buttons are encrypted.

Pedestrians, particularly those with visual impairment, will be greatly benefited if information related to a particular location can be provided to them on demand. The second type of wireless message broadcasted by the receiver may include data acting on which the wireless push button 124 can retrieve information related to the location from a remote server.

The third type of wireless message broadcasted by the receiver includes information related to the current status of a pedestrian signal, direction angle of a crosswalk and geographic coordinate system information about the location etc. which can help autonomous vehicles in navigation.

The receivers are configured to continuously scan the area around them for any request signal. As in step 304 of FIG. 3, the receiver 101, upon receipt of a request signal, carries out checks to determine the source device from which the request signal is received by the receiver 101 for registration of pedestrian signal. The source device transmitting the request signal can be the push button 116 of receiver 101, the one or more wireless push buttons 124 and/or the one or more similar receivers 102 installed at the other traffic poles at the intersection. As in step 306 of FIG. 3, if the receiver 101 on traffic pole 206 finds that the signal received by it is from the wireless push button (wireless push button is also referred to as remote push button alternatively hereinafter) 124, then the angle value received from the wireless push button 124 is compared by the processor 122 with those stored for the crosswalk directions 214 and 216. If the received wireless push button angle value is found to be within a predetermined range of values close to the actual receiver angle value stored in the receivers 101 for direction 214 as in step 312, then the processor 122 sets a flag (hereinafter referred to as remote flag) on to indicate that the signal was received from the wireless push button 124 as in step 316 and also closes the relay 108 to register the request for a pedestrian signal as in step 318. As described above, in a preferred embodiment, the wireless push button 124 and the receiver 101 thereafter enter into an association or pairing for further communication between them. The processor 122 also increments an audio timer by the amount of time the wireless push button was pressed by the user as in step 320. In some embodiments, the wireless push button may be configured to include an indication in the message sent along with the wireless push button angle value and the pedestrian signal request to indicate the type of user to the receiver. For example, if the type of user of the wireless push button is visually impaired then the pedestrian signal request can be configured to indicate the receiver that the request is from a visually impaired pedestrian.

Figure 4:
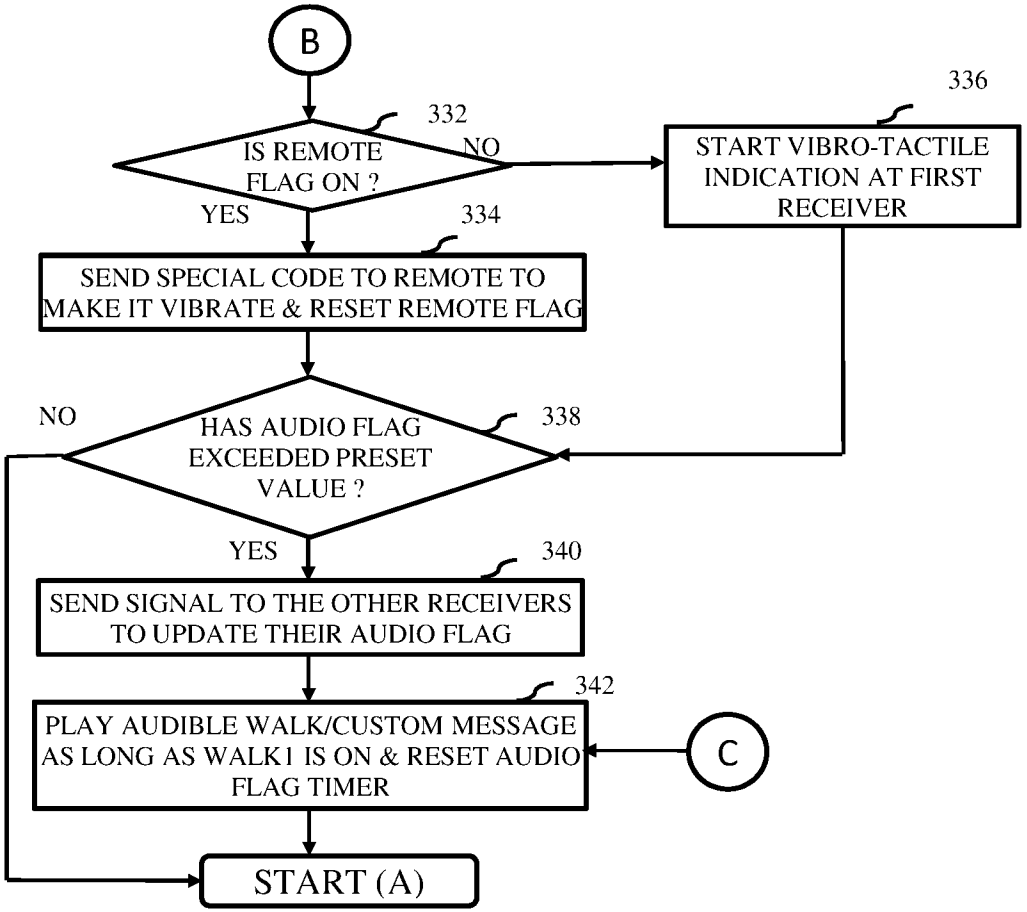

The one or more receivers 101 or 102 installed can interact among themselves wirelessly or through network Ethernet/wired connections. As such, as in step 308, if the receiver 101 finds that the signal received is not from a wireless push button 124, but from another receiver 102 installed at any of the traffic poles 208, 210 or 212, and is for the intended direction 214, then the receiver 101 checks to verify if the pedestrian signal in the desired crosswalk direction 214 (hereinafter the signal in the direction 214 is also referred to as WALK1 alternatively) is already on (i.e. WALK1 is on) as in step 310. If the WALK1 is found to be on at that moment of time then the audio player 105 included in the receiver 101 plays an acknowledgement in the form of a message stored in the memory of the audio player 105 to indicate that the WALK1 is on as in step 342 of FIG. 4. This message is played as long as the WALK1 remains on. The audible acknowledgement played can include any type of message, including but not limited to, recorded human voice or any other types of sound and can be stored in electronic format in the SD card or in any other memory device. In some embodiments, the receiver plays the audio as acknowledgement in response to signal received from the traffic controller. The traffic controller can make out when a pedestrian signal request is received and the time duration for which the push button is pressed. Accordingly, when the Walk signal is turned on, the traffic controller can set a pin high to indicate to the receiver that an audible message should be played.

If the receiver 101 finds, as in step 314, that the said person has actually pressed the push button 116 (i.e. signal is from the first receiver 101 itself), then the audio flag timer is incremented accordingly as in step 320 by the processor 122.

Figure 5:
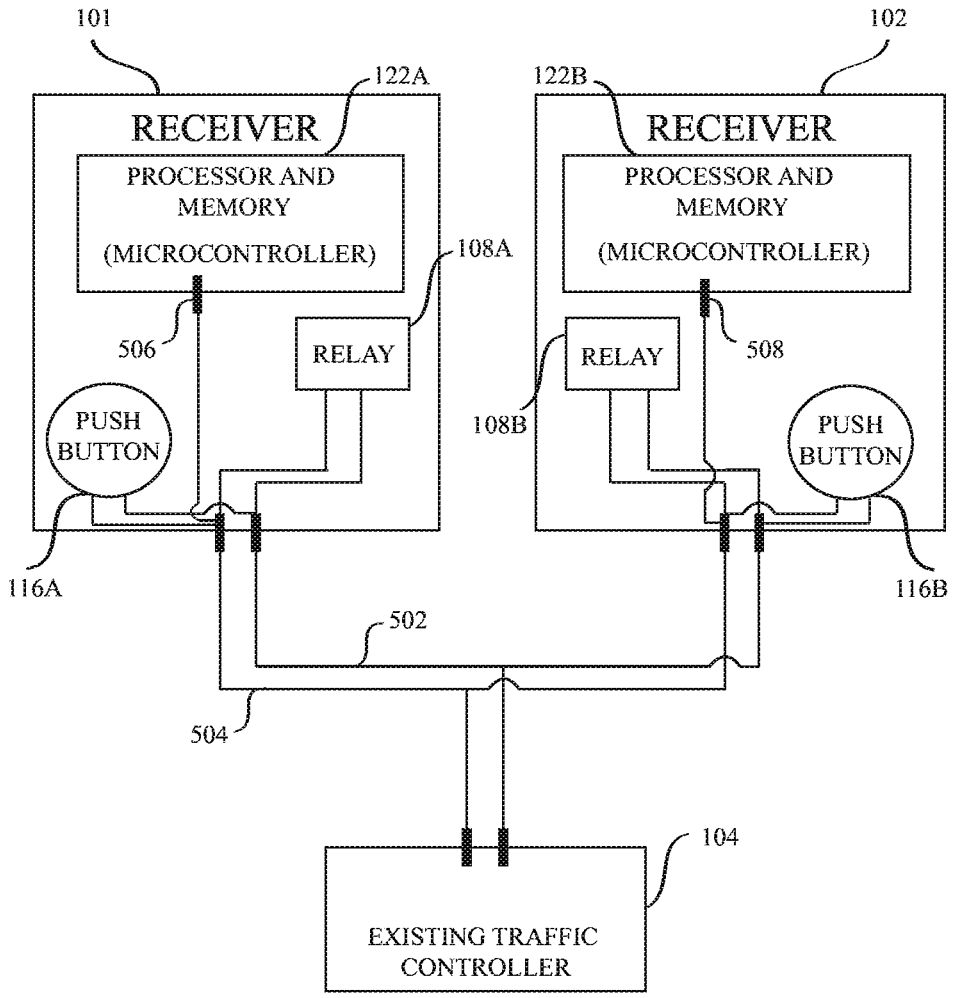
FIG. 5 shows a wiring diagram between two receivers and an existing traffic controller in accordance with an embodiment of the present invention.

FIG. 5 illustrates a schematic wiring diagram which shows an exemplary wired connection among two or more receivers and an existing traffic controller. Each of the lines interconnecting blocks in the diagram (such as wires 502 and 504) illustrates wires connecting the components. In the context of the present example, the receiver 101 installed at traffic signal pole 206 is connected through wires with receiver 102 installed at traffic signal poles 208 and/or 212 and also with the existing traffic controller 104. The microcontroller (122A or 122B) is a specialized type of digital computer used to provide automatic sequencing or control of a system. Microcontrollers include several dedicated pins for input and/or output of digital signals, and limited memory. The microcontrollers can be configured to understand discrete voltage level: either "high" (approximately +V) or "low" (approximately ground potential) measured at a specified pin on the chip. With reference to FIG. 5, the input pins 506 and 508 of the microcontrollers 122A and 122B can change voltage, for example, to go high whenever a positive voltage is detected. When the pedestrian presses the push button 116A on the receiver 101 the input pin 506 of the microcontroller 122A goes high (or low as per setting). The same happens when the relay 108A gets closed to register a request for a pedestrian signal received from a wireless push button 124 as in step 318. Since, receiver 101 mounted on traffic signal pole 206 and the other receiver 102 mounted on the traffic signal pole 208 located at the opposite end of the crosswalk 214 are both connected to the existing traffic controller 104, the input pin 508 of the microcontroller 122B of receiver 102 also goes high as soon as the input pin 506 of microcontroller 122A goes high. Similarly, if input pin 508 of microcontroller 122B goes high due to activation of push button 116B or due to closing of relay 108B, the input pin 506 of microcontroller 122A also goes high. Thus, whenever a receiver on one side of a crosswalk receives a request for registration of a pedestrian signal, the receiver installed on the other side of the crosswalk also becomes aware of this request.

After the audio flag timer is incremented, as in step 320 by the processor 122, the receiver 101 then checks for any conflict or malfunction that may exist in the existing traffic/pedestrian signal systems from the inputs received through pedestrian signal terminals 120 as in step 322. For example, crosswalk 214 can be considered unsafe for pedestrians if the Do Not Walk signal and Walk signal for the same crosswalk 214 are on at the same time. Similarly, the crosswalk 214 is considered unsafe if walk is on in both directions 214 and 216 together. After confirming that there exists no conflict or malfunction in the pedestrian/traffic signals, the receiver 101 again checks if the WALK1 is on at that moment as in step 324. On finding WALK1 on, the receiver 101 then finds whether the request for registering pedestrian signal was received from the wireless push button 124 or from the receiver 101 itself, as in step 332 of FIG. 4, by checking the status of the remote flag. If the request was received due to pressing of push button 116 on the receiver 101 itself, then the vibrating device 112, which can be a vibrating motor, is turned on to make the body of the receiver 101 or any part thereof vibrate as an acknowledgement as in step 336. This vibro-tactile indication lets the user of the receiver 101, who can be a visually impaired and/or hearing impaired person, know that the Walk is on in the desired direction. If the WALK1 is on and the request received was from the wireless push button 124, then a special code is transmitted through the wireless module 110 to the wireless push button 124 to make the wireless push button 124 give vibro-tactile acknowledgement to the user as in step 334 of FIG. 4. At the same time, the remote flag is also reset.

If the pedestrian continuously keeps on pressing the wireless push button 124 and, if the Walk signal in the desired direction is found to be in on condition, the wireless push button 124 can assist the pedestrian throughout the crosswalk by giving a continuous kind of vibro-tactile and/or audible indication/acknowledgement. This may be accomplished by a combination of two methods. Firstly, the wireless push button continuously keeps on comparing the wireless push button angle with the receiver push button angle received by it from the receiver with whom an association has been established before while requesting for pedestrian signal. If the pedestrian deviates from the direction of the desired crosswalk, then the wireless push button angle will change and, if the deviation is found to be beyond the predetermined acceptable range of receiver angle, the wireless push button will stop giving vibro-tactile and/or audible indication. Secondly, the wireless push button also makes use of the strength of the signal broadcasted from the receiver (also referred to as the second receiver) installed at the approaching end of the crosswalk to ensure that the pedestrian is moving in the right direction. Combination of these two methods increases the accuracy of giving guidance, in terms of vibro-tactile and/or audible indication, to the pedestrians.

Be it from the wireless push button 124 or from the push button on the receiver 101, on receipt of a call for registration of pedestrian signal request by the receiver 101, the processor 122 also checks if the audio flag timer has exceeded a preset/predetermined time period (e.g. 3 seconds) as in step 338. In some preferred embodiments, there can be provided separate audio timers for the wireless push button 124 and for the receivers 101. If the said user keeps the push button 116 or wireless push button 124 pressed for a certain period of time that exceeds the preset or predetermined time period value (e.g. if pressed for 4 seconds when the preset value is 3 seconds), then a signal is transmitted to the other receivers 102 as in step 340. This signal is sent for updating the audio flags in the other receivers 102 so that, when the preset value is exceeded, the other relevant receiver 102, along with the pole pedestrian push button 101, play the audio signal at their ends as in step 342 to acknowledge/inform the users that the Walk is on in the desired direction of crosswalk. In some embodiments, irrespective of the time for which the wireless push button is pressed, the concerned receivers can play an audible acknowledgement if they find that the received pedestrian signal request include a message to indicate that it was from a visually impaired pedestrian user. In case of wired connections, as described above, the receiver on the other side of the crosswalk automatically becomes aware when the user keeps the push button 116 or wireless push button 124 pressed for a certain period of time that exceeds the preset or predetermined value. The present invention ensures that all the receivers in the desired walk direction play the same audio signal acknowledgement and a pedestrian can hear the audio no matter whether the pedestrian is near or away from the first receiver while walking through the desired crosswalk. In a preferred embodiment, receivers located at the opposite ends of a crosswalk can play the audio messages alternately so that a visually impaired person finds it easier to follow the audio messages to head in the right direction. In a preferred embodiment, the receivers learn and record in their individual memory the number of times a Don't Walk sign is flashed before a steady Don't Walk sign is displayed at a crosswalk where the receivers are installed. The receivers then use this data to play an audible countdown at a crosswalk to enable a pedestrian know the time left to cross a crosswalk safely. For example, if Don't Walk signal is flashed for 15 times at a signal then the receiver records the time period and/or the counts for these 15 numbers of Don't Walk flashes. Accordingly, afterwards, whenever the Don't Walk starts flashing after the Walk interval, the receiver plays audible countdown starting from count number 15, then next numbers 14, 13 and so forth in tandem with the flashing of Don't Walk sign. In another embodiment of the present invention, when one receiver becomes master and informs all other receivers to play walk tune when the walk is on, only the receivers in the same direction of crosswalk would listen and rest of the receivers will ignore the message. For example, if North-South direction crosswalk receiver sends a message, then only the other receivers for North-South crosswalk direction would record the message and the East-West direction receivers would ignore the message.

In some embodiments, the receiver 101 can also play audio messages to indicate flashing of Do Not Walk for a certain period of time or till the solid Do Not Walk signal comes on.

If the receiver 101 finds that no conflict exists on checking as in step 322 and the WALK1 is found off while further checking as in step 324, it is again checked to find out if the call for registration of pedestrian signal request came from the wireless push button 124 (i.e. whether the remote flag is on) as in step 326. Reference to FIG. 1, if the call came due to pressing of wireless push button 124, then a message is sent back to the wireless push button 124 to acknowledge that a pedestrian signal request has been registered and to wait for the pedestrian signal to come as in step 330. In some preferred embodiments of the present invention, the acknowledgement messages sent to the wireless push button 124 can also include the second type of wireless message and/or digital files which carry relevant information of pedestrian signal status as well as information about location/address details related to the traffic intersection. These messages can then be played at the wireless push button 124 which includes a speaker. In some embodiments, the receiver 101 broadcasts messages when the Walk signal starts and, the wireless push button 124, with whom an association has been previously established by the receiver 101, can play audible acknowledgement to indicate that the Walk sign has been turned on. If the call for registration of pedestrian signal request was initiated due to pressing of push button 116 on the receiver 101, then request for pedestrian signal is registered and an audio message is played as an acknowledgement at the pedestrian pole push button 101 for wait as in step 328. In some embodiments, the message is played at both the receiver 101 and at the wireless push button 124 together irrespective of the source of the request for pedestrian signal. The one or more arrays of LEDs 118 glow to indicate WALK or DO NOT WALK WAIT corresponding to the status of the pedestrian signal and same become visible through the translucent/transparent WALK and WAIT DO NOT WALK indications marked on the body of the receiver 101. In some embodiments, the visual indication provided to the users through the receivers 101 can be in the form of textual messages such as WALK, DO NOT WALK etc. while in some other embodiments such visual indication could be presented through graphical icons such as that of walking man to indicate walk signal and stop hand icon to indicate do not walk signal etc.

In one embodiment, the receiver is configured to detect presence of any autonomous vehicle in its surroundings based on signals transmitted by autonomous vehicles. If a receiver detects presence of any such autonomous vehicle, it can send a message (e.g. a special flag) included in the broadcasted wireless messages (e.g. in third type of wireless message) to alert wireless push button users about the presence of the autonomous vehicle.

In another embodiment, the receiver is capable of detecting level of sound/noise in the environment. For this purpose the receiver may have a microphone included in it. The receiver can measure the sound/noise in the environment and, accordingly, it adjusts the volume automatically for the audible messages played at the receiver so that the audible messages are loud enough for the users.

As described above, it is obvious that the one or more pole receivers with pedestrian push button of the present invention provide an integrated accessible pedestrian system which compliments and supports the functions of a wireless push button besides being able to provide an accessible pedestrian system independently.

Flowchart is used to describe the steps of the present invention. While the various steps in this flowchart are presented and described sequentially, some or all of the steps may be executed in different orders, may be combined or omitted, and some or all of the steps may be executed in parallel. Further, in one or more of the embodiments of the invention, one or more of the steps described above may be omitted, repeated, and/or performed in a different order. In addition, additional steps, omitted in the flowchart may be included in performing this method. Accordingly, the specific arrangement of steps shown in FIGS. 3 and 4 should not be construed as limiting the scope of the invention.

What is claimed is:

1. An integrated pedestrian access system, said system comprising one or more wireless push buttons adapted to transmit and receive wireless signals and one or more receivers connected to one or more traffic controllers and to one or more pedestrian signal heads, wherein said one or more receivers are configured to at least:

communicate with said one or more wireless push buttons through a plurality of wireless messages;

communicate among a plurality of said one or more receivers;

determine whether a source device from which a signal for registering a pedestrian signal request is received through said communication is said one or more wireless push buttons or said one or more receivers;

determine a status of pedestrian signal, when pedestrians proximity to a crosswalk at a time when the request was received by the receiver, based on one or more signals received from said one or more pedestrian signal heads or from said one or more traffic controllers;

register said pedestrian signal request if a walk signal of a pedestrian signal is not on in a desired direction as per said status of pedestrian signal; and provide an acknowledgement corresponding to said status of pedestrian signal through said source device.

2. The integrated pedestrian access system as in claim 1, wherein said acknowledgement corresponding to said status of pedestrian signal through said source device is a vibro-tactile indication.

3. The integrated pedestrian access system as in claim 2, wherein said vibro-tactile indication is produced through vibration of a body of said one or more receivers.

4. The integrated pedestrian access system as in claim 1, wherein said acknowledgement corresponding to said status of pedestrian signal through said source device is an audible indication.

5. The integrated pedestrian access system as in claim 4, wherein said audible indication corresponding to said status of pedestrian signal includes one or more pieces of audio containing description of a traffic intersection.

6. The integrated pedestrian access system as in claim 4, wherein said audible indication corresponding to said status of pedestrian signal through said source device is played when said signal for registering said pedestrian signal request is received for more than a predetermined time period.

7. The integrated pedestrian access system as in claim 1, wherein said plurality of wireless messages broadcasted by said one or more receivers comprise a first type of wireless message that includes a receiver angle value stored by each of said one or more receivers.

8. The integrated pedestrian access system as in claim 7, wherein a wireless push button of said one or more wireless push buttons is configured to receive said plurality of wireless messages upon activation, to check if a wireless push button angle value calculated by said wireless push button falls within a predetermined acceptable range of values corresponding to said receiver angle value and, if found acceptable, to transmit said wireless push button angle value along with said pedestrian signal request.

9. The integrated pedestrian access system as in claim 8, wherein an association is established between a receiver of said one or more receivers and said wireless push button transmitting said wireless push button angle value when said wireless push button angle value received by said receiver is found to be falling within said predetermined acceptable range of values corresponding to said receiver angle value.

10. The integrated pedestrian access system as in claim 9, wherein said association is done through any wireless data exchange standards.

11. A method for registering pedestrian signal requests in an integrated pedestrian access system, said system comprising one or more wireless push buttons adapted to transmit and receive wireless signals and one or more receivers connected to one or more traffic controllers and to one or more pedestrian signal heads, wherein said one or more receivers are configured to at least communicate with said one or more wireless push buttons and with a plurality of said one or more receivers, said method comprising steps of: communicating with said one or more wireless push buttons through a plurality of wireless messages being generated continuously or periodically from said plurality of receivers, wherein said plurality of wireless messages broadcasted by said plurality of receivers comprise a first type of wireless message that includes a receiver angles value stored by each of said one or more receivers;

determining whether a source device from which a signal for registering a pedestrian signal request is received through said communication is said one or more wireless push buttons or is said one or more receivers, wherein said source device being recorded angle of orientation by a compass present within said plurality of wireless push button when said wireless push button in a direction of a crosswalk determining a status of said pedestrian signal request, when pedestrians proximity to said crosswalk at a time when the request was received by the receiver, based on one or more signals received from said one or more pedestrian signal heads or from said one or more traffic controllers;

registering said pedestrian signal request if a walk signal of a pedestrian signal is not on in a desired direction as per said status of pedestrian signal; and providing an acknowledgement corresponding to said status of pedestrian signal through said source device.

12. The method for registering pedestrian signal requests in an integrated pedestrian access system as in claim 11, wherein said acknowledgement corresponding to said status of pedestrian signal through said source device is a vibro-tactile indication.

13. The method for registering pedestrian signal requests in an integrated pedestrian access system as in claim 12, wherein said vibro-tactile indication is produced through vibration of a body of said one or more receivers.

14. The method for registering pedestrian signal requests in an integrated pedestrian access system as in claim 11, wherein said acknowledgement corresponding to said status of pedestrian signal through said source device is an audible indication.

15. The method for registering pedestrian signal requests in an integrated pedestrian access system as in claim 14, wherein said audible indication corresponding to said status of pedestrian signal includes one or more pieces of audio containing description of a traffic intersection.

16. The method for registering pedestrian signal requests in an integrated pedestrian access system as in claim 14, wherein said audible indication corresponding to said status of pedestrian signal through said source device is played when said signal for registering said pedestrian signal request is received for more than a predetermined time period.

17. The method for registering pedestrian signal requests in an integrated pedestrian access system as in claim 11, wherein said communication includes a plurality of wireless messages broadcasted by said one or more receivers comprising a first type of wireless message that includes a receiver angle value configured for each of said one or more receivers.

18. The method for registering pedestrian signal requests in an integrated pedestrian access system as in claim 17, wherein a wireless push button of said one or more wireless push buttons is configured to receive said plurality of wireless messages upon activation, to check if a wireless push button angle value calculated by said wireless push button falls within a predetermined acceptable range of values corresponding to said receiver angle value and, if found acceptable, to transmit a message including said wireless push button angle value along with said pedestrian signal request.

19. The method for registering pedestrian signal requests in an integrated pedestrian access system as in claim 18, wherein a first condition for establishing an association between a receiver of said one or more receivers and said wireless push button transmitting said wireless push button angle value is fulfilled if said wireless push button angle value falls within said predetermined acceptable range of values corresponding to said receiver angle value.

20. The method of registering pedestrian signal requests in an integrated pedestrian access system as in claim 19, wherein said association is done through any wireless data exchange standards.

21. The method of registering pedestrian signal requests in an integrated pedestrian access system as in claim 19, wherein, after said association, on keeping activated, said wireless push button provides a continuous kind of said acknowledgement as long as said wireless push button angle value remains within said predetermined acceptable range of values corresponding to said receiver angle value.

22. The method of registering pedestrian signal requests in an integrated pedestrian access system as in claim 21, wherein said wireless push button provides said continuous kind of said acknowledgement on detection of a signal strength of said communication broadcasted from a second receiver of said one or more receivers installed at an approaching end of a crosswalk opposite to said receiver with which said association has been established.

23. The method of registering pedestrian signal requests in an integrated pedestrian access system as in claim 19, wherein said receiver first records numbers of a don't walk signal flashing based on said one or more signals received from said one or more pedestrian signal heads and plays an audible countdown in tandem with said don't walk signal flashing from a next cycle of said pedestrian signal.

24. The method of registering pedestrian signal requests in an integrated pedestrian access system as in claim 18, wherein said message further includes an indication to indicate a type of user of said one or more wireless push buttons.

25. The method for registering pedestrian signal requests in an integrated pedestrian access system as in claim 19, wherein said communication includes a messages broadcasted by said receiver when said walk signal of said pedestrian signal starts and said wireless push button with which said association has been established by said receiver plays an audible acknowledgement to indicate that said walk sign has been turned on.

26. The method for registering pedestrian signal requests in an integrated pedestrian access system as in claim 17, wherein said plurality of wireless messages broadcasted by said one or more receivers include a second type of wireless message acting on which said wireless push button retrieves one or more information from a remote server.

27. The method for registering pedestrian signal requests in an integrated pedestrian access system as in claim 17, wherein said plurality of wireless messages broadcasted by said one or more receivers include a third type of wireless message comprising a plurality of information related to said status of pedestrian signal, said receiver angle and a geographic coordinate system of a location of said one or more receiver which assists an autonomous vehicle in navigation.

28. The method for registering pedestrian signal requests in an integrated pedestrian access system as in claim 17, wherein said receiver angle value is retrieved by said one or more wireless push buttons from a back end server.

29. The method for registering pedestrian signal requests in an integrated pedestrian access system as in claim 19, wherein a second condition for establishing said association between said receiver and said wireless push button is fulfilled if said wireless push button remains within a predetermined maximum distance from said receiver.

30. The method for registering pedestrian signal requests in an integrated pedestrian access system as in claim 27, wherein said third type of wireless message further comprises a message to give an alert through said one or more wireless push buttons about a presence of said autonomous vehicle if said one or more receivers detect presence of said autonomous vehicle in its surroundings.

* * * * *